US005370501A

United States Patent [19]

Udall

[11] Patent Number: 5,370,501

[45] Date of Patent: Dec. 6, 1994

[54] FAN FOR A DUCTED FAN GAS TURBINE ENGINE

[75] Inventor: Kenneth F. Udall, Derbyshire, England

[73] Assignee: Rolls-Royce plc, London, England

[21] Appl. No.: 81,096

[22] Filed: Jun. 25, 1993

[30] Foreign Application Priority Data

Jul. 21, 1992 [GB] United Kingdom ..... 9215469

[51] Int. Cl.[5] ..... F01D 5/30

[52] U.S. Cl. ..... 416/216; 416/220 R; 416/245 R

[58] Field of Search ..... 416/216, 217, 219 R, 416/220 R, 245 R

[56] References Cited

U.S. PATENT DOCUMENTS

| | | | |
|---|---|---|---|
| 3,393,862 | 7/1968 | Harrison | 416/193 A X |
| 5,007,800 | 4/1991 | Hacault et al. | 416/220 R |
| 5,018,941 | 5/1991 | Heurtel et al. | 416/217 |
| 5,022,822 | 6/1991 | Sincere | 416/219 R X |
| 5,131,814 | 7/1992 | Przytulski et al. | 416/217 |
| 5,165,856 | 11/1992 | Schilling et al. | 416/217 |

FOREIGN PATENT DOCUMENTS

| | | |
|---|---|---|
| 163370 | 5/1921 | United Kingdom . |
| 543557 | 3/1942 | United Kingdom . |
| 689216 | 3/1953 | United Kingdom . |
| 2245032 | 2/1991 | United Kingdom . |

*Primary Examiner*—Edward K. Look
*Assistant Examiner*—Michael S. Lee
*Attorney, Agent, or Firm*—Cushman, Darby & Cushman

[57] ABSTRACT

A fan for a ducted fan gas turbine engine comprises a hub carrying an array of generally radially extending fan blades. The hub is hollow and tapered in an axial direction. The radially outer hub surface is provided with a plurality of generally axially extending slots. The slots receive corresponding stepped teeth provided on the radially inner ends of the fan blades. A nose cone engages the upstream end of the roots of the fan blades to ensure that the teeth are retained in the slots.

6 Claims, 2 Drawing Sheets

FAN FOR A DUCTED FAN GAS TURBINE ENGINE

FIELD OF THE INVENTION

This invention relates to a fan for a ducted fan gas turbine engine and in particular to a fan which is light in weight but nevertheless sufficiently robust to perform in a satisfactory manner.

BACKGROUND OF THE INVENTION

Modern ducted fan gas turbine engines are conventionally provided with a front fan which comprises a plurality of radially extending aerofoil blades mounted on a common hub or disc. Each fan blade is provided at its radially inner end with a root, often of dovetail cross-sectional form, which locates axially in a correspondingly shaped retention groove formed in the fan disc.

The fan blades are relatively large in order to ensure that they satisfy the air flow requirements of the engine. They also must be sufficiently robust to withstand the impact of airborne foreign objects which may be drawn into the engine. This all results in fan blades which are heavy and therefore require a large and heavy fan disc to support them.

It is an object of the present invention to provide a fan for a ducted fan gas turbine engine which is lighter than has conventionally been the case.

SUMMARY OF THE INVENTION

According to the present invention, a fan for a gas turbine engine comprises a hub and a plurality of fan aerofoil blades attached to, and generally radially extending from, said hub, said hub being of hollow, axisymmetric form and of axially progressively increasing diameter from its upstream end to its downstream end, means being provided on said hub for the attachment thereof to a gas turbine engine drive shaft to be driven thereby, the radially outer surface of said hub defining a plurality of concentric annular slots having axial depth and coaxial with the longitudinal axis of said hub, each of said fan aerofoil blades having a root provided with a plurality of teeth arranged in steps to axially locate in said annular slots so as to be radially constrained thereby, means being provided to inhibit movement of axial fan blades relative to said hub in an axially upstream direction to thereby retain said teeth in said slots.

BRIEF DESCRIPTION OF THE DRAWINGS

The present invention will now be described, by way of example, with reference to the accompanying drawings in which.

DETAILED DESCRIPTION OF THE INVENTION

Figure 1:
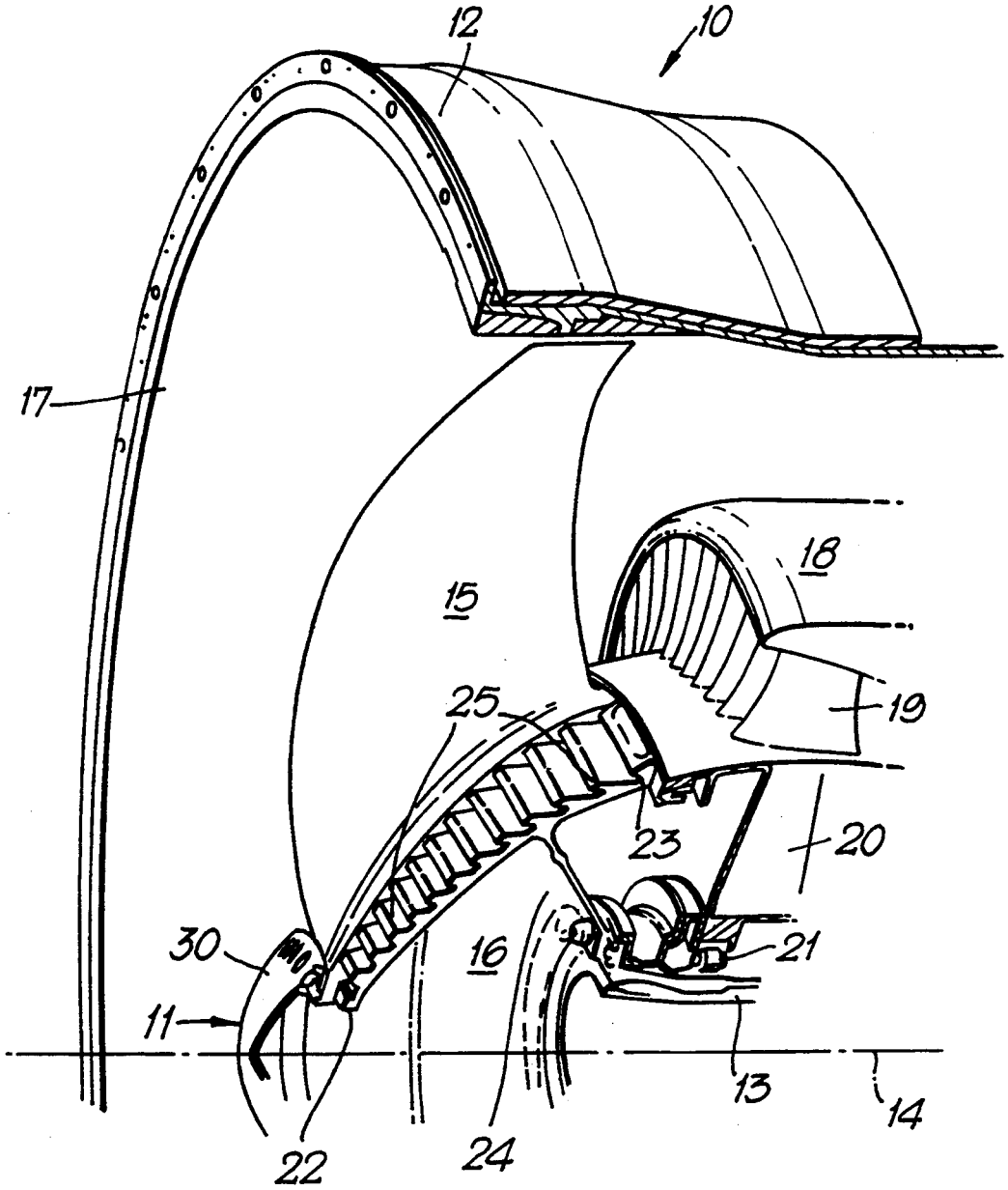
FIG. 1 is a partially broken away view of the fan assembly at the front of a ducted fan gas turbine engine.

With reference to FIG. 1, a ducted fan gas turbine engine fan assembly generally indicated at 10 comprises a fan 11 which is contained within an annular fan casing 12. The fan is attached to the upstream end of a hollow shaft 13 which extends to a turbine (not shown) at the downstream end of the engine. Appropriate bladed discs are attached to the shaft 13 at its downstream end so as to drive the shaft 13, and hence the fan 11 about the engine, longitudinal axis 14.

The fan 11 comprises a plurality of fan blades 15, only one of which is shown in FIG. 1, which are attached to a hub 16. The fan blades 15 extend in a generally radially outward direction and are of aerofoil cross-section configuration. Upon rotation of the fan 11 about the axis 14, air is drawn in through the engine air inlet 17. That air is accelerated by the fan 11 before being divided into two concentric annular flows by an annular splitter member 18. The radially outer flow is exhausted from the gas turbine engine to provide propulsive thrust. However the radially inner flow is directed by a plurality of inlet guide vanes 19 into the engine core. There it is compressed and mixed with fuel. The resultant mixture is combusted in the conventional manner to provide hot gases which expand through and thereby drive, the engines turbines before being exhausted to atmosphere to provide additional propulsive thrust.

Struts 20, mounted radially inwardly of the inlet guide vanes 19, carry a roller bearing 21 which supports the upstream end of the shaft 13.

The hub 16 is of hollow, axisymmetric form. It diameter progressively increases in an axial direction from its upstream end 22 to its downstream end 23. An inclined drive flange 24 interconnects the radially inner surface of the downstream region of the hub 16 with the flanged upstream end of the drive shaft 13. Thus the hub 16 is supported solely by the upstream end of the shaft 13 and rotates therewith.

Figure 2:
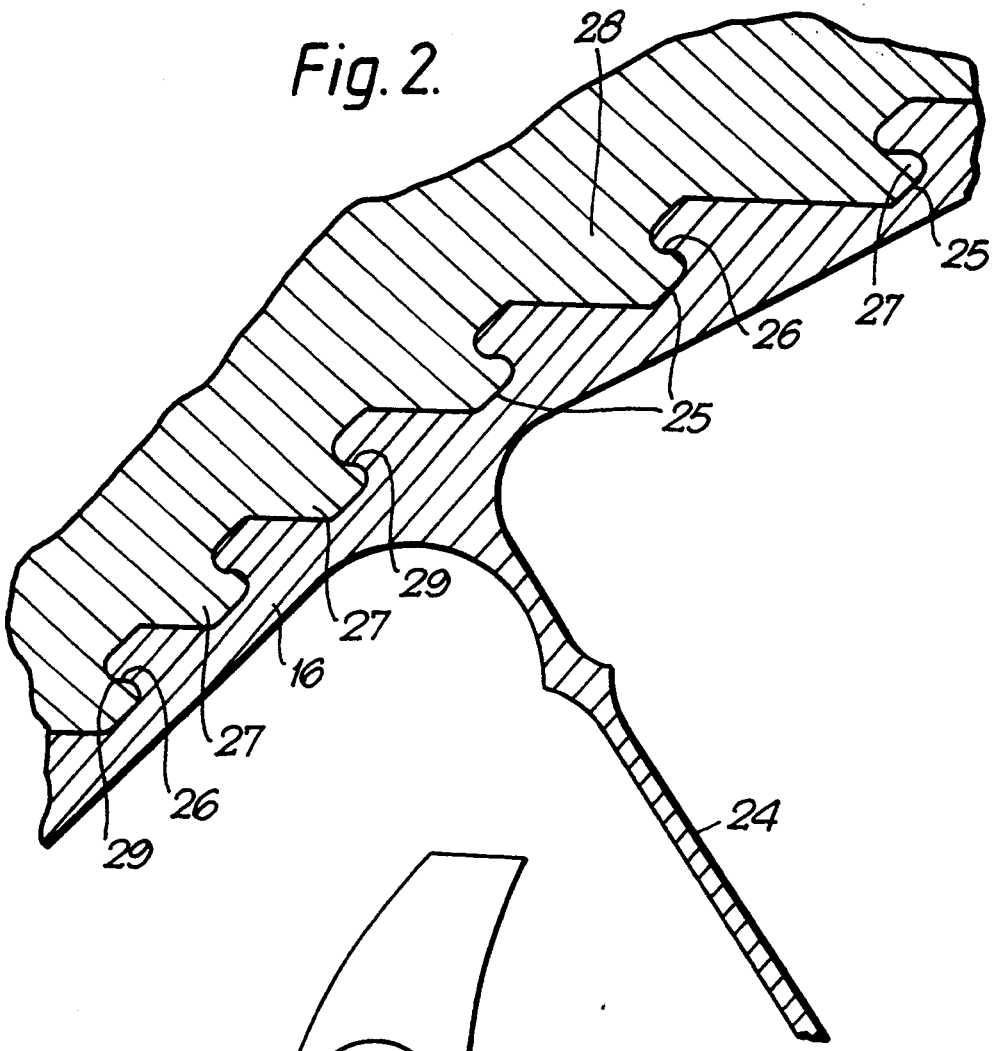
FIG. 2 is a sectioned side view, on an enlarged scale, of part of the interconnection between one of the fan blades of the fan assembly shown in FIG. 1 and the fan hub.

The radially outer surface of the hub 16 comprises a large number of similar concentric annular slots 25 which have axial depth. The slots 25 are coaxial with the engine longitudinal axis 14. Their configuration can be seen more easily if reference is now made to FIG. 2. Each slot 25 is so configured as to define a radially inwardly facing annular face 26, most of which is equidistant from the engine axis.

The slots 25 receive correspondingly shaped teeth 27 provided on the root 28 of each fan blade 15. The teeth 27 are generally axially extending and arranged in the form of steps so as to locate in the different diameter slots 25. Each tooth 27 is provided with a radially outwardly facing annular face 29 which is so configured as to cooperate with a corresponding radially inwardly facing face 26 in one of the annular slots 25. The arrangement is such that upon rotation of the hub 16, each fan blade 15 is restrained radially by the interaction between its tooth faces 29 and the slot faces 26.

Movement of the fan blades 15 in an axially upstream direction is prevented by a nose cone 30 which is attached by bolts to the upstream end of the hub 16.

The nose cone 30 engages the upstream ends of the fan blade roots 28, thereby preventing the root teeth 27 from becoming axially disengaged from the hub slots 25.

It will be seen therefore that the hub 16, when attached to the end of the shaft 13 by the inclined drive flange 24, and having the nose cone 30 and blades 15 attached to it, is a relatively stiff and strong structure. The flexible directions of each component are supported by the stiff directions of each adjacent component, the whole forming an integral structure of greater capability than the sum of its parts. It is therefore able to carry the high centrifugal loads imposed upon it by the fan blades 15 as it rotates. It forms a stable platform to anchor the blades 15 against vibratory loading, and resists distortion under abnormal circumstances, such as blade 15 failure. It is able to do this without the necessity for large amounts of heavy structural material in its construction. The hub 16 is therefore considerably lighter in weight than would be the case with an equivalent hub of conventional construction.

Figure 3:
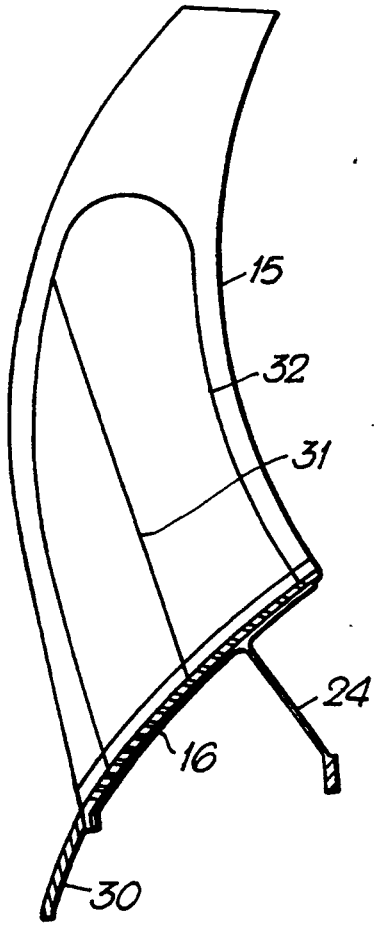
FIG. 3 is a sectioned side view of part of the fan of the fan assembly shown in FIG. 1.

Referring now to FIG. 3, it will be seen that in order for the hub 16 to accommodate all of the annular slots 25, its diameter increases rapidly from its upstream end to its downstream end. This results in the hub having what is commonly referred to as a steep "hade". Such a steep hade brings additional advantages such as a certain degree of centrifugal air compression as well as axial compression and improved tolerance to foreign object ingestion. Thus foreign objects passing into the radially inner regions of the fan 11 tend to bounce off the hub 16 and don't enter the vulnerable engine core.

A further advantage of the steep hub hade is that the fan blades 15 can be of essentially axially swept or curved configuration as can be seen in FIG. 3. This results in the fan 11 generating less noise than one having conventional generally straight fan blades. Additionally, the fan blades 15 are less liable to tip buckling and impact damage and are generally more aerodynamically efficient than conventional fan blades.

If the fan blade 15 is manufactured from a fibre reinforced material, the fibres in the material can be orientated as shown at 31 within the region defined by the boundary 32. Such orientation of the fibres in which they are radially inclined is an axially upstream direction improves containment in the event of fan blade failure, and improves the impact deflection characteristics of the fan blades 15.

It will be seen therefore that fan assemblies 11 in accordance with the present invention are considerably lighter than conventional fan assemblies without any compromise in their strength characteristics. Moreover, the performance characteristics of the fan assembly 11 are superior to those of conventional fan assemblies.

I claim:

1. A fan for a gas turbine engine comprising a hub and a plurality of fan aerofoil blades attached to, and generally radially extending from, said hub, each blade having a curved root portion with said root portion having a leading and trailing edge with at least three teeth projecting from said root portion between said edges, said hub having upstream and downstream ends and being of hollow, axisymmetric form, said hub axially progressively increasing in diameter from said upstream to said downstream end, attachment means for attaching said hub to an engine drive shaft so as to be driveable thereby, said hub having a radially outer surface having a plurality of annular slots concentric with the rotational axis of the hub, said annular slots being located on said hub so as to extend from said upstream end to said downstream end of said hub, each annular slot having an axial depth defining an opening facing in the upstream direction with each opening having a radially inner surface, a radially outer surface and a bottom surface with each surface of each opening shaped to directly engage one of said teeth provided on said root portion of each said aerofoil blade to radially constrain the blade, each said tooth engaging in and being fully inserted in a respective annular slot, said fan having a restraining member attached to said hub for preventing movement of said fan blades relative to said hub in an axially upstream direction to thereby retain said teeth in said respective annular slots.

2. A fan as claimed in claim 1 wherein said restraining member provided to inhibit movement of said fan blades relative to said hub comprises a nose cone attached to the upstream end of said hub and adapted to engage the upstream ends of the radially inner root portions of said fan blades.

3. A fan as claimed in claim 1 wherein said attachment means for attaching said shaft and said hub comprises an annular drive flange interconnecting the upstream end of said shaft with the downstream region of the radially inner surface of said hub.

4. A fan as claimed in claim 1 wherein each of said fan blades is of generally axially curved configuration.

5. A fan as claimed in claim 4 wherein each of said fan blades is formed from a fibre reinforced material, at least some of the reinforcing fibres extending lengthwise of each blade being inclined in an axially upstream direction.

6. A fan for a gas turbine engine comprising a hub and a plurality of fan aerofoil blades attached to, and generally radially extending from, said hub, each blade having a curved root portion with said root portion having a leading and trailing edge with at least three teeth projecting from said root portion between said edges, said hub having upstream and downstream ends and being of hollow, axisymmetric form, said hub axially progressively increasing in diameter from said upstream to said downstream end, attachment means for attaching said hub to an engine drive shaft so as to be driveable thereby, said hub having a radially outer surface having a plurality of annular slots concentric with the rotational axis of the hub, said annular slots being located adjacent to one another continuously along said hub between said upstream end to said downstream end of said hub, each annular slot having an axial depth defining an opening facing in the upstream direction with each opening having a radially inner surface, a radially outer surface and a bottom surface with each surface of each opening shaped to directly engage one of said teeth provided on said root portion of each said aerofoil blade to radially constrain the blade, each said tooth engaging in and being fully inserted in a respective annular slot, said fan having a restraining member attached to said hub for preventing movement of said fan blades relative to said hub in an axially upstream direction to thereby retain said teeth in said respective annular slots.

* * * * *